United States Patent [19]

Winter

[11] 4,172,812

[45] Oct. 30, 1979

[54] CATALYTIC CRACKING PROCESS

[75] Inventor: William E. Winter, Baton Rouge, La.

[73] Assignee: Exxon Research & Engineering Co., Florham Park, N.J.

[21] Appl. No.: 892,486

[22] Filed: Apr. 3, 1978

[51] Int. Cl.[2] ..... C10G 11/02; C10G 37/06

[52] U.S. Cl. ..... 208/72; 208/16; 208/97

[58] Field of Search ..... 208/80, 67, 15, 72, 208/97

[56] References Cited

U.S. PATENT DOCUMENTS

| | | | |
|---|---|---|---|
| 2,903,414 | 9/1959 | Marisic et al. | 208/80 |
| 2,981,674 | 4/1961 | Good | 208/70 |
| 3,692,667 | 9/1972 | McKinney et al. | 208/120 |
| 3,761,391 | 9/1973 | Conner | 208/76 |
| 3,775,287 | 11/1973 | Bryson et al. | 208/120 X |
| 3,784,463 | 1/1974 | Reynolds et al. | 208/74 |
| 3,928,172 | 12/1975 | Davis et al. | 208/77 |
| 3,948,757 | 4/1976 | Strother | 208/74 |
| 3,997,427 | 12/1976 | Eng et al. | 208/67 |

*Primary Examiner*—Delbert E. Gantz
*Assistant Examiner*—G. E. Schmitkons
*Attorney, Agent, or Firm*—Llewellyn A. Proctor

[57] ABSTRACT

A process which comprises recracking a cracked naphtha feed containing up to about 60 percent, suitably from about 20 to about 40 percent olefins, over a crystalline aluminosilicate zeolite catalyst to further crack the naphtha and saturate at least about 50 percent of the olefins, preferably from about 90 percent to about 100 percent of the olefins, based on the weight of said cracked naphtha feed. In a preferred combination a gas oil is catalytically cracked in a first stage to produce a cat cracked naphtha product of high olefin content, and an intermediate or high boiling component thereof, or both, is recracked as a feed in a second stage over a zeolite catalyst to saturate the olefins, and hydrodenitrogenate and hydrodesulfurize said cat cracked naphtha. The recracked cat cracked naphtha is then hydrotreated, or hydrofined, at low to mild severities to provide a low sulfur gasoline suitable for addition to a gasoline blending pool.

15 Claims, No Drawings

CATALYTIC CRACKING PROCESS

Cracking processes, both thermal and catalytic, have constituted the heart of petroleum refining operations for several decades. The purpose of both types of process is the same, i.e., to break heavy molecular feed components into lower boiling, more valuable components. The thermal process, which has now been largely replaced by the more effective catalytic process, accomplishes this result by heat, whereas the catalytic process breaks the large molecules by contact between a heavy feed and an active catalyst at lower temperatures than used in thermal processes. The reactions which occur in the catalytic cracking operation are complex including, not only carbon-carbon bond scission but isomerization, alkylation, dehydrogenation, etc., and a carbonaceous material, or coke, is inevitably deposited on the catalyst. The catalyst, in such unit, is regenerated in a separate vessel, i.e., a regenerator, by burning off the coke to restore its activity. Commonly, the catalyst is continuously cycled between the reactor and regenerator as a moving bed without shutdown of either unit. Illustrative of commercial catalytic cracking processes are Airlift TCC as developed by Mobil Oil Corporation (Petroleum Refiner, Vol. 31, No. 8, August 1952, pp. 71–78); Fluid Catalytic Cracking as developed by Universal Oil Products Company (Petroleum Refiner, Vol. 30, No. 3, March 1951, pp. 130–136); Fluid Catalytic Cracking as developed by Esso Research and Engineering Company, Exxon Research and Engineering Company's predecessor (Petroleum Refiner, Vol. 35, No. 4, April 1956, pp. 201–205); Fluid Catalytic Cracking, Orthoflow, as developed by the M. W. Kellogg Company (Hydrocarbon Processing, Vol. 42, No. 5, May 1963, pp. 135–140); and Houdriflow Catalytic Cracking as developed by Houdry Process and Chemical Company, Division of Air Products and Chemicals, Inc.

The economics of the catalytic cracking unit in a refinery because of its high degree of flexibility, to a large extent, determines the product slate which will be produced by a refinery. Products from the catalytic cracking unit thus provide feed for other units, e.g., alkylation and polymerization units. Cat cycle stocks are used to make lubes, and gas is employed as fuel in the refinery. However, a major portion of the product of the catalytic cracking units of a given refinery are blended directly in gasoline blending pools which serve as supplies of motor gasoline. With the phaseout of lead anti-knock compounds it continues a formidable challenge for the refiner to maintain gasoline pools at the octane levels demanded; and, the problem is aggravated by the depletion of conventional petroleum supplies which creates an increased need to process heavy feedstocks such as residua, unconventional heavy crudes and the like for conversion to gasoline.

The bulk of the sulfur in a gasoline blending pool is contributed by cat naphtha, or product of the cat cracking units. The addition of large amounts of sulfur to a gasoline blending pool raises acute problems, particularly in view of the present requirements of the Clean Air Act to meet emission standards for hydrocarbons (HC) and carbon monoxide (CO); and even more stringent standards which may be imposed by amendments to the Clean Air Act in the 1980's. Thus automobiles are now equipped with catalytic converters for the purpose of lowering emissions of CO and HC, but the new standards will also impose restrictions on $NO_x$ emissions, as well as added restrictions on CO and HC emissions. Sulfur, however, is a known poison for the more useful, and active "three-way" catalysts contemplated by the auto industry for use in catalytic converters to meet the 1980's standards. Consequently, the activity and activity maintenance of the catalysts are suppressed due to the presence of the sulfur. Moreover, it has been found that, due to the presence of the sulfur, the catalytic converters emit sulfate, either as a sulfuric acid aerosol or as particulates caused by sulfuric acid corrosion of the metal portions of the exhaust train. The sulfur in gasoline, which is typically present in amounts of about 300 ppm, is oxidized in the combustion chamber of the engine to sulfur dioxide. The catalytic converter, which is required for lowering the emissions of CO and HC, is thus responsible for the oxidation of sulfur dioxide in the exhaust gas to produce sulfur trioxide which immediately hydrates due to the presence of water vapor, one of the combustion products, to form a sulfuric acid aerosol or acid particulates, neither of which is environmentally acceptable.

Whereas cat naphtha hydrofining might be employed to produce low sulfur gasoline, such treatment would be very expensive for such processes would require considerable hydrogen comsumption, and hydrogen is a rather expensive commodity. Hydrogen constitutes a major cost of hydrotreating a cat naphtha because typically from about 20 to 40 percent of the feed is olefinic, and a considerable amount of hydrogen is required for saturation of the olefins. In addition, in cat naphtha hydrofining mercaptan reversion reactions, or reactions wherein the hydrogen sulfide by product reacts with cat naphtha olefins to form mercaptans is a troublesome problem, and can add to the expense of hydrofining. More importantly, hydrotreating cat naphtha causes significant loss of octane values as a result of olefin hydrogenation (U.S. Pat. No. 3,957,625).

While the degree of olefins saturation with resultant octane loss can be diminished by proper selection of hydrotreating operating variables, and catalyst type, refiners cannot tolerate even small reductions in cat naphtha octane ratings, particularly now when lead is being phased out of gasoline blending pools; much less the loss in naphtha octane ratings caused by further increased olefin saturation resultant from the high severities which now appear to be necessary to lower gasoline sulfur limits within the ranges required to avoid poisoning the three way catalysts which will be used in automotive catalytic converters in the 1980's; or, to avoid sulfate emissions for higher sulfur gasolines which may result from processing heavier, higher sulfur crudes.

It is, nonetheless, the primary objective of the present invention to provide an improved process which will at least in part overcome these and other disadvantages of present catalytic cracking processes, and in fact provide a new and novel multiple stage catalytic cracking process for the cracking of gas oils.

A specific object is to provide a new and novel process for the operation of catalytic cracking units, notably one which desulfurizes and improves the octane number of cracked naphthas obtained by the catalytic cracking of a gas oil.

A more specific object is to provide a process for producing a cat naphtha which can be subsequently hydrofined, even at moderate or severe hydrofining conditions, without significant loss of octane number.

These objects and others are achieved in accordance with the present invention embodying a process, an essential feature of which comprises recracking a cracked naphtha feed containing up to about 60 percent, suitably from about 20 to about 40 percent olefins, over a crystalline aluminosilicate zeolite catalyst to further crack the naphtha and saturate at least about 50 percent of the olefins, preferably from about 80 percent to about 100 percent of the olefins, based on the weight of said cracked naphtha feed. Suitably, the cracked naphtha feed is contacted and reacted over the catalyst, without dilution of said feed, at temperature ranging from about 800° F. to about 1100° F., preferably from about 900° F. to about 1030° F., and at pressure ranging from about 0 to about 50 pounds per square inch gauge (psig), preferably from about 5 psig to about 20 psig, reaction at such conditions not only producing significant saturation of the olefins, but also significant hydrodenitrogenation and hydrodesulfurization of said cat naphtha feed.

In its preferred aspects the process is one wherein a conventional sulfur-bearing cat cracker feed, suitably a gas oil, is catalytically cracked, at conventional conditions, in an initial or first stage to provide a cat naphtha product containing generally from about 10 to about 60 percent, preferably from about 20 to about 40 percent olefins. The cat naphtha product in whole or in part is then recracked, as an undiluted feed, in a subsequent or second catalytic cracking zone over a crystalline aluminosilicate zeolite catalyst. Preferably, the cat naphtha product of the initial or first stage is split into fractions inclusive of an intermediate boiling fraction having a low end boiling point ranging from about 150° F. to about 250° F., preferably from about 180° F. to about 220° F., and a high end boiling point ranging from about 250° F. to about 380° F., preferably from about 270° F. to about 350° F., or higher boiling fraction having a low end boiling point ranging from about 250° F. to about 380° F., preferably from about 270° F. to about 350° F., and a high end boiling point ranging from about 350° F. to about 450° F. preferably from about 400° F. to about 430° F., and said intermediate or high boiling fraction, or composition which includes both, is utilized as a feed and further catalytically cracked, or recracked, in a subsequent stage over a crystalline aluminosilicate zeolite catalyst sufficient to produce significant saturation of the olefins, and hydrodenitrogenation and hydrodesulfurization of said cat cracked naphtha fraction, or fractions. The recracked product is then hydrotreated, or hydrofined, at mild hydrotreating conditions to provide a low sulfur gasoline of improved octane.

It has been found, quite surprisingly, that the recracking of an undiluted cracked naphtha, notably the intermediate or high boiling fractions, over a zeolite catalyst at rather low or mild conditions significantly increases the octane number while reducing the olefin content of the cracked naphtha by saturation of the olefins, without direct hydrogen addition. It is surprising that recracking the cat naphtha in this manner substantially reduces the olefin content while improving the octane since olefins hydrogenation in hydrofining reduces the octane. Thereafter however, a substantially olefins free recracked product can be hydrofined with little or no reduction in octane rating. Not only are the adverse consequences of direct hydrofining avoided, but additionally the sulfur content of the feed is reduced by as much as seventy-five percent, or greater. This, of course, reduces the amount of hydrotreating required to produce low sulfur gasoline, and greatly reduces operating and capital costs. Moreover, the adverse effects associated with the mercaptan reversion reaction are minimized.

Various cracking catalysts can be used in cracking the gas oil feed, or feed to the first stage catalytic cracker. Suitable cracking catalysts include conventional silica-based materials. Exemplary of such catalysts are, e.g., amorphous silica-alumina; silica-magnesia; silica-zirconia; conventional clay cracking catalysts, and the like. The amorphous gel silica-metal oxide cracking catalyst may further be composited with kaolin in amounts of about 10 to 40 wt. % (based on total weight of the composited catalyst) and up to 20 wt. % or more crystalline aluminosilicate zeolite, such as faujasite. A crystalline aluminosilicate zeolite catalyst is required in the second stage catalytic cracker, i.e., for cracking the cat cracked naphtha, or fraction thereof, from the first stage. These catalysts are well known and commercially available. Preferably, the catalyst utilized, particularly in the second stage catalytic cracker is an amorphous silica-alumina catalyst containing from about 5 to 16 weight percent y-type faujasite, and, optionally 15 to 40 percent kaolin.

Generally, the first and second stage catalytic crackers are operated at about the same absolute conditions of temperature, pressure, space velocity, and catalyst-/oil ratio, the runs being initiated by adjusting the feed and catalyst rates, and the temperature and pressure of the reactor to operating conditions. The catalytic cracking operation in both stages of cracking is continued at conditions by adjustment of the major process variables, within the ranges described below:

| Major Operating Variables | Typical Process Conditions | Preferred Process Conditions |
|---|---|---|
| Pressure, Psig | 0–50 | 5–20 |
| Reactor Temp., °F. | 800–1100 | 900–1030 |
| Space Velocity, W/W/Hr | 2–200 | 5–150 |
| Catalyst/Oil Ratio, (Instantaneous Vol. of Reactor Space) lbs./per lb. of oil | 2–12 | 4–8 |

The product of the first stage catalytic cracker, suitably a cat cracked naphtha obtained by cracking a gas oil, is characterized as a cracked naphtha having an olefin content ranging from about 10 percent to about 60 percent, more typically from about 20 percent to about 40 percent (by weight) and boiling within the gasoline range, typically from about 65° F. to about 430° F. (i.e., $C_5$/430° F.). All or a portion of the cat cracked naphtha, preferably an intermediate or heavy fraction, or composition which includes both fractions, as previously defined, is split from the product of said first stage, fed into, and recracked, without dilution, over the crystalline aluminosilicate zeolite catalyst in the second stage catalytic cracker. The recracked product is then subjected to a mild hydrotreatment by contact, with a catalyst comprising a composite of an inorganic oxide base, suitably alumina, and a Group VI-B or Group VIII metal, or both, e.g., a cobalt moly/alumina catalyst, at conditions given as follows, to provide a gasoline suitable for addition to a gasoline blending pool, to wit:

| Process Variable | Typical Process Conditions | Preferred Process Conditions |
|---|---|---|
| Pressure, psig | 60–500 | 80–200 |
| Temperature, °F. | 400–800 | 500–600 |
| Feed Rate, LHSV | 1–80 | 5–20 |
| Hydrogen Rate, SCF/Bbl | 200–4000 | 800–2000 |

The invention will be more fully understood by reference to the following nonlimiting demonstrations and examples which, though in part simulated, present comparative data which illustrate its more salient features. All parts are given in terms of weight unless otherwise specified.

In a first step, a 155° F./413° F. cat naphtha fraction was obtained by catalytically cracking a virgin gas oil at conventional conditions over a conventional catalyst to obtain a cat cracked naphtha, hereinafter referred to as Feedstock A, the complete feedstock inspections of which are given in Table I, below.

Table I

| Feedstock A | |
|---|---|
| 155° F./413° F. Cat Naphtha | |
| Sulfur, wppm | 572 |
| Nitrogen, wppm | 30 |
| Br. No., cc/gm | 24.8 |
| Octane | |
| RONC | 82.8 |
| MONC | 75.2 |
| FIA, Vol. % | |
| Arom. | 33.6 |
| Olefins | 15.3 |
| Saturates | 51.0 |
| ASTM D-86 | |
| IBP/5% | 155/194 |
| 10/20 | 207/228 |
| 30/40 | 245/262 |
| 50/60 | 280/300 |
| 70/80 | 320/337 |
| 90/95 | 365/383 |
| FBP | 413 |

EXAMPLE 1

Feedstock A was hydrofined in a reactor at 550° F., 400 psig, and 800 SCF/B over a cobalt moly-on-alumina catalyst to produce a low sulfur gasoline blending component having a Bromine number of about 5 and 20 wppm sulfur, this requiring about 96.5% hydrodesulfurization. The product has a research octane number (RONC) of 77.3 and a motor octane number (MONC) of 73.0, this representing a loss of 5.5 RONC and a 2.2 loss of MONC as a result of the hydrofining.

EXAMPLE 2

Feedstock A was recracked in a reactor at 930° F., 14.7 psia, 13.7 WHSV and at a catalyst/oil ratio of 9.2 over a conventional commercial zeolite cracking catalyst containing crystalline aluminosilicate zeolite, silica alumina gel and clays, and the product then fractionated to provide a light ends cut, and three fractions, i.e., a low boiling 65/200° F. fraction, an intermediate 200/430° F. fraction and a high boiling 430° F.+ fraction, the low boiling and intermediate boiling fractions being characterized in Table II.

Table II

| | 65/200° F. | 200/430° F. |
|---|---|---|
| Vol. % on Feed | 24.9 | 55.9 |
| Sulfur, wppm | 42 | 244 |
| Br. No. | 20.0 | 3.0 |
| Octane | | |
| RONC | 85.0 | 90.4 |
| MONC | 80.0 | 80.9 |

The 200/430° F. fraction is then hydrofined at 550° F., 400 psig, 800 SCF/Bbl over a cobalt moly-on-alumina catalyst as in Example 1 to produce a low sulfur gasoline blending component having a Bromine No. of about 1 and containing 11 wppm sulfur, this requiring about 95.5% hydrodesulfurization. The resulting product has octane ratings of 89.4 RONC and 80.9 MONC. Thus, the loss in octane rating for this low sulfur gasoline blending component is nil as relates to the motor octane number rating, and only 1 octane number as relates to research octane number.

When the recracked 65/200° F. and 200/430° F. recracked, hydrofined fractions are combined, the resultant product has an octane number of 88.7 RONC and 80.6 MONC, contains only 20 wppm of sulfur, and represents 80.8 vol. percent recovered product, based on the original feed. Octane loss as a result of hydrofining is estimated at about 0.5 RONC, or less.

The following example demonstrates a more preferred embodiment wherein an intermediate fraction only is recracked.

EXAMPLE 3

Feedstock A was split into three fractions, a 65/200° F. fraction, a 200/330° F. fraction, and a 330° F.+ fraction as defined in Table III.

Table III

| | 65/200° F. | 200/330° F. | 330° F.+ |
|---|---|---|---|
| Vol. % on Feed | 17.32 | 61.9 | 20.9 |
| Sulfur, wppm | 100 | 226 | 1,841 |
| Br. No. | 54.6 | 24.6 | 7.8 |
| Octane | | | |
| RONC | 87.5 | 81.6 | 82.5 |
| MONC | 79.2 | 75.2 | 75.0 |

The 65/200° F. fraction is then treated in a Merox process, after admixture with light ends from the 200/330° F. fraction which is recracked as defined hereafter, to produce a product of 87.5 RONC and 79.2 MONC with 50 ppm sulfur.

The 200/330° F. fraction is recracked in a reactor at 930° F., 14.7 psia, 13.7 WHSV at a catalyst/oil ratio of 9.2 over a conventional commercial zeolite cracking catalyst containing crystalline aluminosilicate zeolite, silica alumina gel and clays, and the product then fractionated to provide a 65/200° F. fraction which is blended with the 65/200° F. fraction to Merox, a 200/430° F. fraction, and a 430° F.+ fraction. The 65/200° F. and 200/430° F. fractions are characterized in Table IV.

Table IV

| | 65/200° F. | 200/430° F. |
|---|---|---|
| Vol. % on Feed | 10.7 | 39.3 |
| sulfur, wppm | 67 | 88 |
| Br. No. | 20.4 | 2.7 |
| Octane | | |
| RONC | 87.3 | 89.6 |

Table IV-continued

| | 65/200° F. | 200/430° F. |
|---|---|---|
| MONC | 80.0 | 80.2 |

The 330° F.+ fraction, characterized in Table III, is combined with the 200/430° F. and 430° F.+ recracked fractions then hydrofined over a cobalt moly-on-alumina catalyst at 550° F., 400 psig and 800 SCF/B. The feed entering the hydrofiner (H/F Feed), the product therefrom (H/F Product), and the final product formed by blending the hydrofined product and product from MEROX is characterized in Table V.

Table V

| | H/F Feed | H/F Product | Final Product |
|---|---|---|---|
| Vol. % on Feed | 60.2 | | 88.1 |
| Sulfur, wppm | 711 | 8.2 | 20 |
| Br. No. | 4.5 | 1.1 | |
| Octane | | | |
| RONC | 88.5 | 87.5 | 87.5 |
| MONC | 78.4 | 78.4 | 78.7 |

These data show that the octane loss due to hydrofining the final product is considerably improved as contrasted with hydrofining the original feed, and that octane loss as a result of the hydrofining approximates only 0.8 RON, with no loss in MON octane value. Naphtha yield is considerably improved with no greater octane loss due to hydrofining as contrasted with recracking the whole naphtha.

Recracking a cat naphtha is thus shown to offer definite advantages over the direct hydrofining of a cat cracked naphtha. Moreover, the cracking of an intermediate fraction provides advantages over recracking a whole naphtha in terms of naphtha yield.

It is apparent that various modifications and changes can be made without departing the spirit and scope of the invention.

Having described the invention, what is claimed is:

1. A process for the production of a high octane gasoline comprising cracking a sulfur-bearing hydrocarbon feed in a first cracking zone over a cracking catalyst at conditions sufficient to obtain a cat cracked naphtha product containing from about 10 percent to about 60 percent olefins, based on the weight of said product, withdrawing said cat cracked naphtha as a product from said first cracking zone, splitting said product into components inclusive of a fraction having a low end boiling point ranging from about 150° F. to about 250° F. and a high end boiling point ranging from about 350° F. to about 450° F., recracking said cat cracked naphtha fraction, without dilution with other hydrocarbons, over a crystalline aluminosilicate zeolite catalyst in a second cracking zone to desulfurize said feed, and saturate at least about 50 percent of said olefins, based on the weight of said cat cracked naphtha, hydrofining the product of said second cracking zone over a hydrogenation catalyst at hydrofining conditions in a hydrofining zone to hydrodesulfurize said product, and saturate sufficient of the olefins to form a product suitable for addition to a gasoline blending pool.

2. The process of claim 1 wherein the sulfur-bearing hydrocarbon feed introduced into said first cracking zone is a gas oil boiling below about 1050° F.

3. The process of claim 2 wherein the gas oil boils within a range of from about 600° F. to about 1050° F.

4. The process of claim 1 wherein the cat cracked naphtha product of said first cracking zone contains from about 20 percent to about 40 percent olefins.

5. The process of claim 1 wherein from about 80 to about 100 percent of the olefins of the cat cracked naphtha feed introduced into the second cracking zone is saturated during the reaction.

6. The process of claim 1 wherein the cat cracked naphtha feed introduced into the second cracking zone is reacted at temperature ranging from about 800° F. to about 1100° F. and at a pressure ranging from about 0 to about 50 psig.

7. The process of claim 1 wherein the cat cracked naphtha feed introduced into the second cracking zone is reacted at a temperature ranging from about 900° F. to about 1030° F. and at a pressure ranging from about 5 psig to about 20 psig.

8. The process of claim 1 wherein the cat cracked naphtha obtained as a product from said first cracking zone is split into components inclusive of a fraction having a low end boiling point ranging from about 180° F. to about 220° F. and a high end boiling point ranging from about 400° F. to about 430° F., and said fraction is recracked in the second cracking zone by contact thereof with said crystalline aluminosilicate zeolite catalyst.

9. The process of claim 1 wherein the cat cracked naphtha obtained as a product from said first cracking zone is split into components inclusive of an intermediate fraction having a low end boiling point ranging from about 150° F. to about 250° F. and a high end boiling point ranging from about 250° F. to about 380° F., and said intermediate fraction is recracked in the second cracking zone by contact thereof with said crystalline aluminosilicate zeolite catalyst.

10. A process for the production of a high octane gasoline comprising cracking a sulfur-bearing hydrocarbon feed in a first cracking zone over a cracking catalyst at conditions sufficient to obtain a cat cracked naphtha product containing from about 10 percent to about 60 percent olefins, based on the weight of said product, withdrawing said cat cracked naphtha as a product from said first cracking zone, splitting said product into components inclusive of a fraction having a low end boiling point ranging from about 180° F. to about 220° F. and a high end boiling point ranging from about 400° F. to about 430° F., recracking said cat cracked naphtha product, without dilution with other hydrocarbon feed, over a crystalline aluminosilicate zeolite catalyst in a second cracking zone to desulfurize said feed, and saturate from about 80 percent to about 100 percent of said olefins, based on the weight of said cat cracked naphtha, and then hydrofining the product of said second cracking zone over a hydrogenation catalyst at hydrofining conditions in a hydrofining zone to hydrodesulfurize said product, and saturate sufficient of the olefins to form a product suitable for addition to a gasoline blending pool.

11. The process of claim 10 wherein the sulfur-bearing hydrocarbon feed introduced into said first cracking zone is a gas oil boiling below about 1050° F.

12. The process of claim 11 wherein the gas oil boils within a range of from about 600° F. to about 1050° F.

13. The process of claim 10 wherein the cat cracked naphtha product of said first cracking zone contains from about 20 percent to about 40 percent olefins.

14. The process of claim 10 wherein the cat cracked naphtha feed introduced into the second cracking zone is reacted at a temperature ranging from about 800° F. to about 1100° F. and at a pressure ranging from about 0 to about 50 psig.

15. The process of claim 11 wherein the cat cracked naphtha feed introduced into the second cracking zone is reacted at temperature ranging from about 900° F. to about 1030° F. and at a pressure ranging from about 5 psig to about 20 psig.

* * * * *